United States Patent [19]

Gidseg

[11] 4,304,101

[45] Dec. 8, 1981

[54] CIRCULATING AIR REFRIGERATOR WITH REMOVABLE DIVIDER SHELF

[76] Inventor: Edward Gidseg, 22 Park Pl., Great Neck, N.Y. 11021

[21] Appl. No.: 894,603

[22] Filed: Apr. 7, 1978

[51] Int. Cl.[3] ..... F25D 17/04; F25D 23/00; F25D 11/02

[52] U.S. Cl. ..... 62/187; 62/329; 62/447

[58] Field of Search ..... 62/186, 187, 329, 447, 62/DIG. 13, 417

[56] References Cited

U.S. PATENT DOCUMENTS

| | | | |
|---|---|---|---|
| 3,027,732 | 4/1962 | Mann et al. | 62/329 |
| 3,421,338 | 1/1969 | Gidseg | 62/155 |
| 3,486,347 | 12/1969 | Gidseg | 62/155 |
| 3,590,594 | 7/1971 | Arend | 62/329 X |
| 3,630,046 | 12/1971 | Boor | 62/187 |

*Primary Examiner*—William E. Wayner
*Assistant Examiner*—Harry Tanner
*Attorney, Agent, or Firm*—Pennie & Edmonds

[57] ABSTRACT

An improved refrigerator of the forced refrigerated air type is disclosed in which a divider shelf is provided for the convenience of the user who wishes to convert a portion of the freezer section into a standard refrigeration section or a portion of the standard refrigerator section into a freezer section. The shelf is formed of an insulating material and is dimensioned and shaped to be positioned in a selected compartment in any of a plurality of selectable locations. The shelf has a resilient sealing member along peripheral portions which engage the corresponding walls of the compartment in which it is positioned so as to permit the shelf to selectively alter the flow of refrigerated air in such a manner as to permit the separate thermostatic temperature control of the separate sections created by the shelf. Depending upon the desired application, the shelf may or may not include a thermostatically controlled aperture to further selectively control the flow of frigid air thereby also controlling the temperature of the section thus created. Various constructions of the shelf permit the consumer to conveniently and quickly convert the refrigerator from a standard arrangement to a plurality of selectable and temperature controllable arrangements including an energy saving arrangement in which a part of the standard refrigerator section or freezer section may be totally inactivated.

20 Claims, 12 Drawing Figures

CIRCULATING AIR REFRIGERATOR WITH REMOVABLE DIVIDER SHELF

BACKGROUND OF THE INVENTION

1. Field of the Invention

This invention relates to improvements in refrigerators of the type which utilize forced circulating refrigerated air to provide cooling in the freezer section and the standard refrigerator section of the refrigerator.

As used herein the expression "refrigerator" denotes refrigerators and freezers and combinations thereof. The expression "freezer" section denotes a cooling section in which the temperature is generally maintained at or below the freezing point of water, i.e. 0° C. The expression "standard refrigerator" section or simply "refrigerator" section denotes a cooling storage region, the temperature of which is generally greater than the temperature of the freezer section.

2. Description of the Prior Art

In my U.S. Pat. Nos. 3,421,338 and 3,486,347 there are disclosed several embodiments of a self-defrosting refrigerator of the type contemplated herein wherein refrigerated air is force-circulated through a food storage compartment. The food storage compartment may be in the form of a single freezer or refrigerator compartment or it may be divided into two or more sections, one section being a freezer section and the other section being a refrigerator section.

U.S. Pat. No. 3,486,347 relates to a self-defrosting refrigerator in which the refrigeration system is completely separated from the food storage compartments in modular fashion to thereby permit rapid defrosting of the freezer coils and easy accessibility for servicing mechanical equipment. In one embodiment, the self-defrosting refrigerator includes a food storage compartment divided by a central wall into a freezer section and a refrigerator section. The central wall includes a first opening to permit circulation of chilled air from the freezer section into the refrigerator section and a second opening to permit return circulation of chilled air from the refrigerator section into the freezer section. A refrigerating compartment is adjacent the food storage compartment, the respective compartments being separated by a wall having first and second openings therein which define first and second passageways interconnecting the two compartments. A refrigeration system mounted entirely within the refrigerating compartment includes a compressor, a freezer coil, a defroster coil adjacent the freezer coil supplying heat to melt frost from the freezer coil during a defrosting cycle, a blower adjacent the freezer coil circulating frigid air through the passageways between the first and second compartments and through the first and second openings in the central wall of the first compartment during the refrigeration cycle to cool the freezer section and the refrigerator section.

While the refrigerators of the prior art have progressively improved significantly in numerous respects no refrigerators have yet been devised in which a consumer may selectively, conveniently convert a portion of the freezer section into a standard temperature controlled refrigerator section or a portion of a standard refrigerator section into a temperature controlled freezer section. In addition, it has been impossible to date to inactivate a portion of a refrigerator while maintaining the remaining portions in active temperature controlled operation. I have invented a technique in which such advantages are made readily available in refrigerators of the circulating air type by the inventive provision of an insulated divider shelf as will be described.

SUMMARY OF THE INVENTION

This invention relates to improvements in a refrigerating apparatus of the type which utilizes circulating refrigerated air to cool and thermostatically control the temperature of at least a first compartment, in which at least one divider shelf is provided which is formed at least in part of at least one insulating material and dimensioned and configured to be positioned at any of a plurality of selectable locations within the compartment. The shelf contemplated by the invention at least includes sealing means positioned along peripheral portions thereof to engage corresponding inner wall portions of the compartment in sealed relation sufficient to prevent the flow of air by any sealed portions when the shelf is positioned in one of the selectable locations. The sealing means extends at least over a sufficient portion of the periphery of the shelf such that when the shelf is positioned in one of the selectable locations, it divides the compartment into at least two sections and alters the flow of refrigerated air such that one section of the compartment has a thermostatically controlled temperature which differs by a preselected margin from the thermostatically controlled temperature maintained in the other section.

In its preferred form the refrigerating apparatus is of the type which includes a food storage compartment divided into vertical freezer and refrigerator sections separated by a central wall and a modular refrigerating compartment positioned atop the food storage compartment and containing the necessary refrigeration components and hardware to circulate refrigerated air downwardly through an opening in the ceiling of the food storage compartment so as to thermostatically control the freezer section. The downward movement of the refrigerated air is guided by a conduit which is formed by a perforated wall having bent end portions or brackets secured to the rear wall of the freezer compartment to maintain the perforated wall in spaced relation with the rear wall of the freezer section. The wall may be solid or slotted and is more usually perforated and defines a refrigerated air duct. The purpose of the perforations is to permit relatively minor amounts of refrigerated air to move into the freezer proper while the major portions of the refrigerated air move along a conduit formed by the perforated wall. The lower end of the perforated wall is spaced from the floor of the freezer to permit the circulating air to return around the perforated wall upwardly to a return opening communicating with the refrigerating compartment for recycling and further cooling. The refrigerating cycle—and hence, the refrigerated air—in the freezer, is thermostatically controlled while the defrosting cycles are suitably controlled in a known manner as described in my U.S. Pat. Nos. 3,421,338 and 3,486,347.

Refrigeration of the refrigerator section is facilitated by a thermostatic control and associated damper which selectively permits by way of a suitable baffling system, refrigerated air from the refrigerating compartment to flow, via the freezer section, into the refrigerator section as needed to maintain the preset ambient temperature selected therein. Return of the refrigerated air passing through the refrigerator section is facilitated by an opening at the bottom portion of the vertical wall between the sections which communicates the refrigerator section with the freezer section. Thus, it will be seen that, although the temperature of the refrigerator and freezer sections are independently controlled, the refrigerator section actually derives its cooling ability by selectively accepting refrigerated air from the source of refrigerated air flowing into the freezer section.

The particular arrangement and cooling technique utilized in such refrigerators makes it possible to provide in the freezer section an insulating shelf having suitable sealing material adhesively or otherwise attached to a major peripheral portion of the shelf in the embodiment which will be described. The freezer and refrigerator compartments have a rectangular cross-sectional configuration and the shelf is provided with sealing means along the three sides which correspond to the side and rear walls of the freezer while it is conveniently dimensioned to provide a space between the forward side thereof and the freezer door. Thus, refrigerated air is substantially prevented from bypassing the shelf causing the shelf to convert the lower portion of the freezer section into a refrigerator section under the same thermostatic control as the thermostatic control of the adjacent refrigerator section thereby converting the lower portion of the freezer section into an extension of the adjacent refrigerator section. The upper portion of the freezer section is thus retained as a freezer and the flow of return air from the refrigerator section to the freezer section is permitted up to the refrigerating compartment via the space provided between the forward side of the shelf and the freezer door, which space essentially acts as an extension of the refrigerated air return opening in the bottom portion of the vertical wall dividing the refrigerator and freezer sections. Accordingly the area of the space is preferably comparable to, or slightly greater than, the area of that opening.

Alternately, the shelf may be provided with sealing means on all sides. However, in this arrangement it is necessary to provide for the return of spent refrigerated air from the standard refrigerator section and this may be accomplished by the provision of a suitable conduit or conduits having apertures at selectable locations with removable plugs corresponding to anticipated positions of the shelf. When not in use, the apertures are inactivated by suitable closures such as removable plugs.

A shelf of the same type may also be positioned in the refrigerator section to convert the upper portion of the refrigerator section into a freezer section while maintaining the lower portion of the refrigerator portion below the shelf as a standard refrigerator. In this arrangement however it is necessary to provide an aperture in the shelf together with a thermostatic control and associated damper to control the size of the aperture in response to ambient temperature measurements of the lower refrigerator section. At the same time it will be necessary to adjust or deactivate the standard thermostatic control provided in the upper portion of the central vertical wall so as to maintain the factory provided damper in the open position so as to permit the free flow of refrigerated air from the freezer section into the refrigerator section. Alternately the thermostatic control and the damper may be completely removed.

The shelf is preferably constructed of a suitable insulating material such as polyurethane foam, glass fiber, polystyrene, etc., having laminations on each side of a suitable material such as metal, plastic, etc., and having a suitable resilient sealing member such as an elastomer seal adhesively secured to the appropriate peripheral portions. Where required the temperature control and associated damper provided with the shelf may have the same construction as the temperature control and associated damper provided with the refrigerator; however any suitable temperature and aperture controlling device may be used. Although the shelf may be supported on shelf brackets appropriately provided in the freezer and refrigerator sections, it is also contemplated to position the shelf directly on a standard grate-type food shelf or other support.

In another arrangement in the standard side-by-side freezer/refrigerator combination it is possible to position a shelf within the standard refrigerator section providing the shelf with sealing means on all four sides to inactivate the lower portion of the refrigerator section below the shelf thereby providing a substantial reduction of energy consumption. In connection with this arrangement it will be necessary to provide a path for the return of spent refrigerated air from the portion of the refrigerator section above the shelf and this may be facilitated either by a series of apertures in the central vertical wall having selectively removable plugs corresponding to anticipated shelf locations or by a conduit communicating with the central wall and a series of apertures and closures as previously described to facilitate direct return of the spent air to the refrigerating compartment. Such an inactivating energy saving shelf will be utilized by a consumer whose refrigeration needs change from time to time. Reactivation of the inactivated portion of the refrigerator section may be provided by simply removing the shelf and repositioning the plugs to their appropriate apertures.

It will become readily apparent from the description that follows that various combinations and arrangements can be obtained by those skilled in the art utilizing the basic concepts disclosed herein. For example, the refrigerator and freezer sections may have other cross-sectional configurations than those disclosed and the food storage compartment may be in the form of a single freezer compartment or a side-by-side freezer compartment or any combination thereof. In addition, it is possible to envision the use of a plurality of shelves of the present inventive type to divide a single food storage compartment into a plurality of thermostatically progressively warmer temperature controlled sections. It is only necessary in such an arrangement to maintain the thermostatic temperature control of each of the sections formed by a given shelf to permit the flow of spent refrigerated air back to the refrigerating compartment.

BRIEF DESCRIPTION OF THE DRAWINGS

Preferred embodiments of the invention are described hereinbelow with reference to the drawings, partially in cross-section, wherein.

In the description which follows, the expression "refrigerator section" contemplates an above-freezing fresh food section of the type normally utilized in refrigerators intended for fresh foodstuffs; the expression "freezer section" contemplates a below-freezing freezer section of the type normally utilized in refrigerators intended for frozen foodstuffs.

DESCRIPTION OF THE PREFERRED EMBODIMENTS

Figure 1:
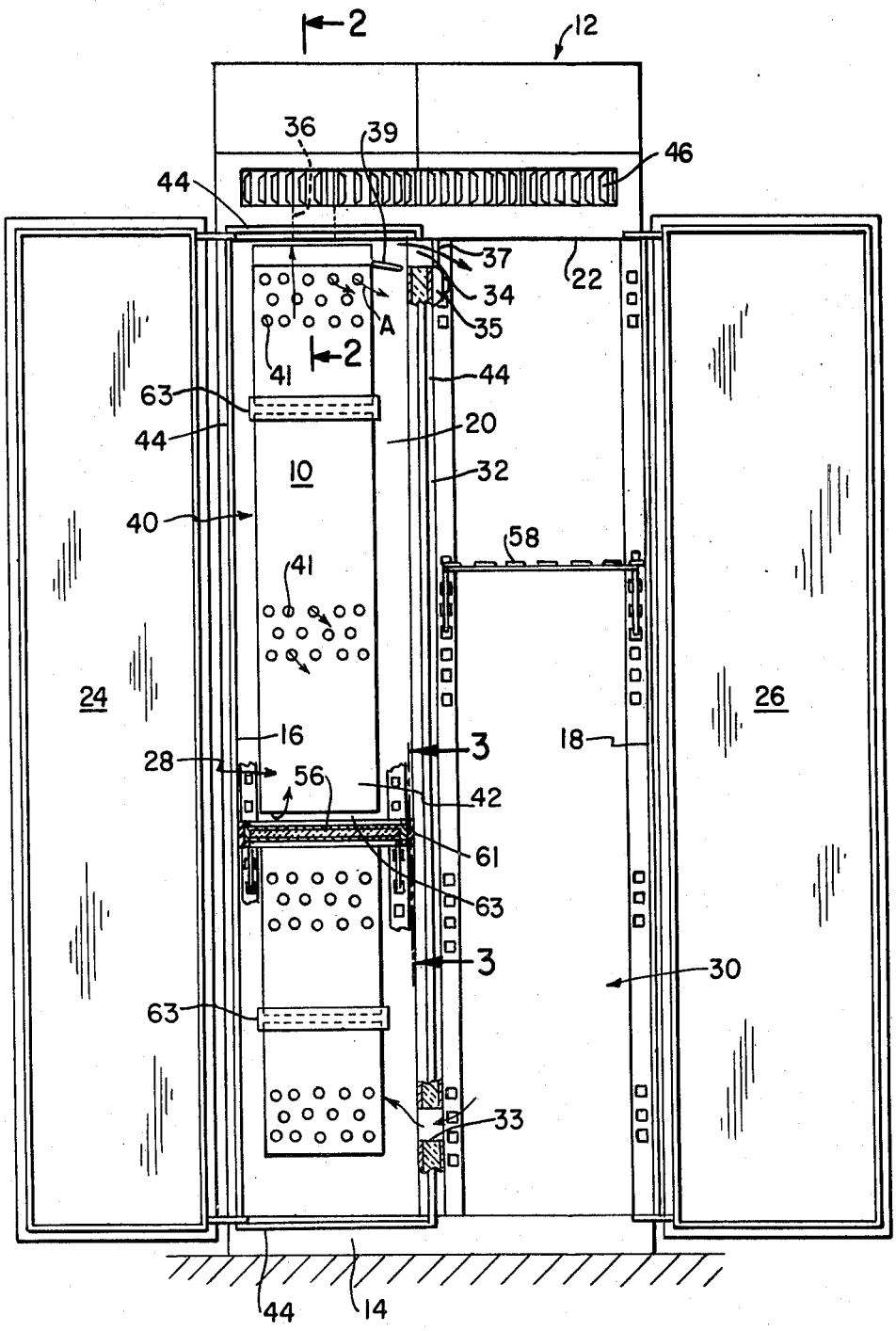
FIG. 1 is a front elevational view of a side-by-side refrigerator/freezer combination of the type contemplated by the invention illustrating the use of an insulating shelf in the freezer section.

Referring initially to FIG. 1, there is illustrated an upright self-defrosting refrigerator having two major compartments namely (a) a food storage compartment 10, and (b) a refrigerating compartment 12. The food storage compartment 10 is completely insulated and is of conventional construction in that it has a rectangular base 14, a pair of vertical side walls 16 and 18, respectively, a vertical rear wall 20, a ceiling 22, and a pair of doors 24 and 26 mounted on hinges at the front portions of the vertical side walls 16 and 18, respectively. The food storage compartment 10 is divided into two sections, a freezer section 28 and a refrigerator section 30, by a central wall 32 which extends vertically from the base 14 to the ceiling 22 in a plane parallel to that of side walls 16, 18. The central wall 32 divides the food storage compartment 10 approximately in half but the exact proportions are a matter of design choice only. The central wall 32 has an opening 34 toward the rear near the portion at which it joins the ceiling 22, which opening 34 allows circulation of air between the freezer section 28 and the refrigerator section 30.

Figure 2:
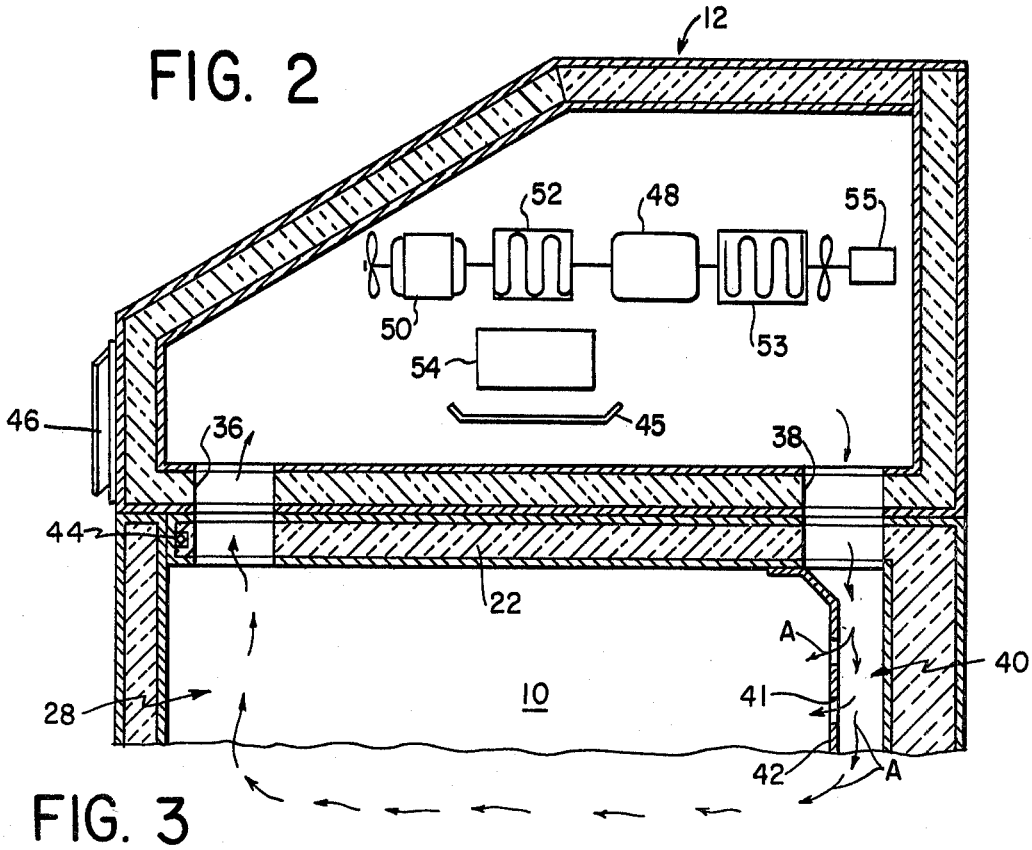
FIG. 2 is an enlarged cross-sectional view taken along lines 2—2 of FIG. 1, with certain refrigeration components illustrated schematically.

As shown in FIG. 2, the ceiling 22 of the food storage compartment 10 has a pair of openings 36 and 38, positioned in the freezer section 28 adjacent its forward and rear marginal edges, respectively. A cold air circulating duct 40 is formed at the rear portion of the freezer section by a perforated wall 42 extending vertically downwardly from opening 38 and ceiling 22 and terminating at the lower portion of the rear wall 20 at a location spaced above the rectangular base 14. An electrically heated mullion strip 44 is mounted on the forward marginal portion of the freezer section 28 to prevent ice from forming on the marginal edges and to insure an airtight seal between the central wall 32 and the doors 24 and 26.

Figure 9:
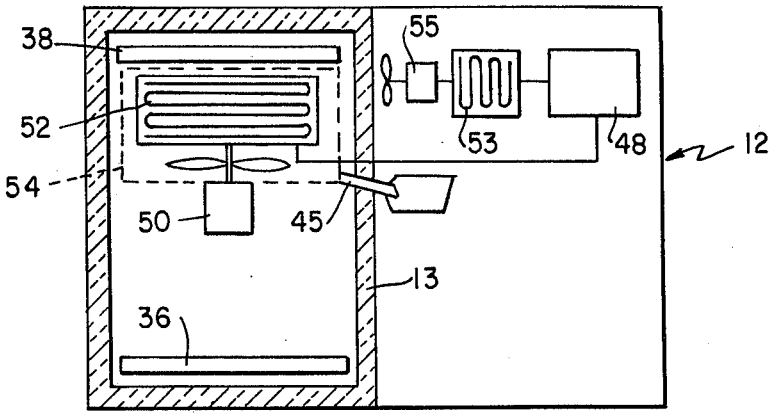
FIG. 9 is a view, partially in cross-section, taken along lines 9—9 of FIG. 2 and illustrating schematically, the refrigeration components.

As shown in the drawings, the refrigerating compartment 12 is also completely insulated by the walls being constructed of an insulating material such as polyurethane foam material. The refrigerating compartment 12 may have a cross section as illustrated in FIG. 2 or it may have a rectangular or other configuration depending upon design and style choices. The refrigerating equipment included in the refrigerating compartment 12 are of the type disclosed in my U.S. Pat. Nos. 3,421,338 and 3,486,347, including exhaust grills 46 and conventional circulating air refrigerating equipment such as compressor 48 and motor and fan 50, refrigerating coil 52, condenser coil 53 and optional condenser fan and motor 55, and related defrosting equipment 54 including a melted frost collection pan and means 45 for collecting and exhausting the melted frost from the refrigerating compartment into the ambient temperature environment for evaporation as shown schematically in FIG. 2. For convenience of FIG. 2, the compressor 48 and condenser coil 53 are shown schematically in the same compartment as the fan and refrigerating coil. However, they are, in fact, separated from those components by an insulated wall 13 as shown in FIG. 9 and as described in my U.S. Pat. Nos. 3,421,338 and 3,486,347.

Without consideration of the effect of horizontal divider shelf 56—which will be described below—the operation of the standard refrigerator shown in the drawings provides a flow of refrigerated air from the refrigerating compartment 12 downwardly through duct 40 with major portions of the refrigerated air flowing downwardly through the duct 40 formed by perforated wall 42 and around the lower end portion of wall 42 upwardly into return opening 36, as shown in FIGS. 1 and 2. As illustrated by the arrows A in FIGS. 1 and 2, minor portions of the refrigerated air are permitted to flow through the perforatations 41 of wall 42 to provide relatively uniform dispersement of the refrigerated air. Thus, on-off cycling of the refrigerating mechanism is controlled by the thermostatic setting of the freezer compartment in a known manner and the temperature of that compartment in most instances is generally maintained at temperatures below the freezing temperature of water.

Referring once again to FIG. 1, the standard refrigerator section 30 shown to the immediate right of freezer section 28 is separated by insulated vertical wall 32 which includes upper opening 34 and lower opening 33 as described and shown. Upper opening 34 has associated immediately adjacent thereto a thermostatic control 35 and control damper 37 (or other suitable temperature-airflow control device) shown schematically in FIG. 1. The regulator senses the temperature of the refrigerator compartment 30 and when the temperature of that compartment is below a predetermined setting, thermostat 35 opens damper 37 to permit a portion of the refrigerated air from duct 40 to be directed into the refrigerator compartment 30 by a deflecting baffle 39 (shown schematically) and opening 34 thereafter to be directed downwardly through refrigerator compartment 30 and to return to the freezer compartment 28 via opening 33 and vertical wall 32. Upon returning to the lower portion of the freezer compartment 28 the spent refrigerated air rises and joins the upward flow of air returning on the forward side of wall 42 upwardly into return opening 36 of ceiling 22 of the freezer compartment. A standard open gate-type food shelf 58 is shown in refrigerator section 30.

When the temperature of the refrigerator section 30 of food storage compartment 10 is lowered to the predetermined dedired level, control 35 actuates damper 37 to progressively reduce the opening 34 to restrict further entry of refrigerated air from duct 40 into refrigerator section 30, thus increasingly restricting the downward flow of refrigerated air to a path defined by duct 40 and through perforations 41 as described previously. The temperature of the freezer section 28 of food storage compartment 10 is thus controlled by the flow of refrigerated air downwardly through duct 40 and upwardly through opening 36 of ceiling 22 in accordance with the usual temperature sensing and thermostatic setting techniques thereby controlling the on-off cycling of the refrigerating apparatus. Since the flow of refrigerated air from refrigerating section 12 is thermostatically controlled by the freezer temperature requirements, thus both freezer section 28 and refrigerator section 30 will be thermostatically controlled. Except during the defrost cycle, the air circulating motor 50 remains in operation whether or not the rest of the refrigerating apparatus has cycled off to permit the thermostatic control to constantly sense ambient temperature and to ensure proper air flow through all compartments.

Figure 3:
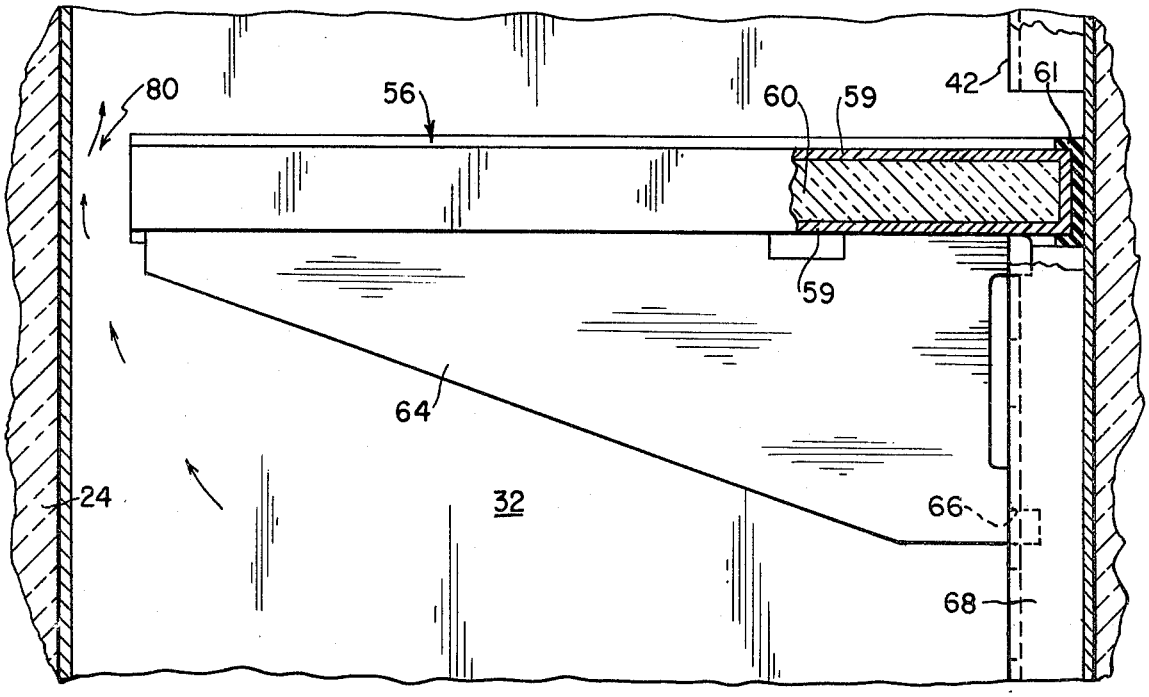
FIG. 3 is an enlarged cross-sectional view with parts broken away, taken substantially along lines 3—3 of FIG. 1.

Referring once again to FIG. 1, an embodiment of the invention is illustrated in which an insulating shelf 56 formed at least in part of an insulating material such as polyurethane foam material 60, having suitable metal layers 59, is positioned within freezer section 28 in one of a plurality of selectable locations. The shelf 56 illustrated in FIG. 1 has a rubber seal 61 or other suitable sealing material on the three peripheral sides such that when positioned in any of the selectable locations the seal 61 engages two side walls and rear wall 20 of the freezer section and prevents by substantial flow of refrigerated air between any sealed portion and the adjacent engaged wall portion. As shown in FIGS. 3 and 6B, the shelf 56 is dimensioned such that the forward side is spaced inwardly from the door 24 to define space 80 when in the closed position to permit the return of spent refrigerated air from refrigerator section opening 33 and up to the refrigerating compartment 12.

In operation, when the shelf 56 is positioned as shown in FIG. 1 in freezer section 28, refrigerated air will flow from refrigerating compartment 12 through opening 34 in accordance with the thermostatically-controlled requirements of the refrigerator section 30. The refrigerated air flows downwardly in refrigerator section 30 and returns to freezer section 28 via opening 33 located at the lower portion of vertical wall 32. The refrigerated air from refrigerator section 30 will thus maintain the temperature of the portion of section 30 in accordance with the requirements of thermostatic control 35 of refrigerator section 30. Thus it will be appreciated that the lower portion of what was originally freezer section 28 below shelf 56 is converted into a standard refrigerator section and the portion above shelf 56 will remain a freezer section. The flow of return air from refrigerator section 30 and opening 33 upwardly to refrigerating compartment 12 is permitted by dimensioning the shelf 56 so as to provide a space 80 shown schematically in FIG. 6B between the shelf 56 and the freezer door 24 when the door is in the closed position. The return of refrigerated air of the freezer compartment upward toward refrigerating compartment 12 is facilitated by provision of space 63 provided between the lower portion of preforated wall 42 and the upper surface of shelf 56 as shown in FIG. 1. As a practical matter, a plurality of such spaces 63 at anticipated shelf locations may be provided in perforated wall 42 as shown in FIG. 1 when the apparatus is supplied to the consumer with the addition that each space may be deactivated by a cover plate (not shown) which is simply removable when the consumer desires to insert shelf 56 at any of a plurality of such locations. If shelf 56 is to be inserted by the consumer at a location where a space 63 is provided, the cover plate may simply be removed for insertion of shelf 56 at the selected location. Shelf 56 will convert the entire lower portion of the freezer section 28 into a standard refrigerator section, in effect rendering the portion of the freezer section 28 below shelf 56 as an extension of the standard refrigerator compartment 30.

It should be noted that the space may be made sufficiently narrow so as to minimize the effect on the air flow and to obviate the need for a deactivating cover plate, yet, such space may be wide enough to receive shelf 56.

Thus, it will be seen that as the result of the particular forced air refrigerating technique utilized in the refrigerating apparatus described, a plurality of relatively inexpensive alternatives are available to the consumer to permit the consumer to readily provide a major alteration of the food storage compartment 10 by having the ability to convert a substantial portion of the freezer section 28 into a standard refrigerator section. Such a shelf may be relocated or removed by an unskilled consumer in several moments in accordance with current needs at any time and without professional assistance.

Although the shelf 56 shown in FIGS. 1 and 3 is mounted on a shelf bracket 64 held in position by openings 66 provided in vertical supports as shown, the shelf 56 may alternately be in the form of an insulating shelf positioned on a metal grate type refrigerator rack of a known type.

Figure 4:
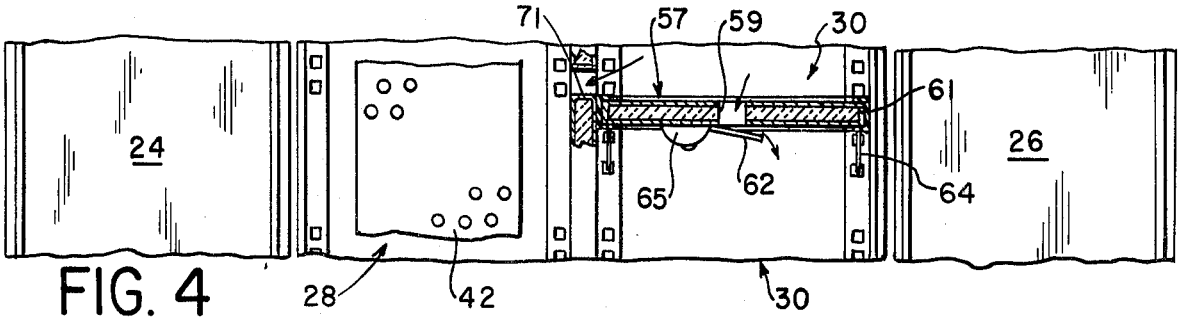
FIG. 4 is a fragmentary front elevational view of a refrigerator of the type illustrated in FIG. 1 illustrating the use of a thermostatically controlled insulating shelf in the refrigerator section.

Referring now to FIG. 4, there is illustrated a fragmentary front elevation of a side-by-side food storage compartment of the type shown in FIG. 1 having what would normally be the freezer section 28 to the left of the center and what would normally be the standard refrigerator section 30 to the right of center with doors 24 and 26, respectively, attached by suitable hinges as described in connection with the embodiment of the invention illustrated in FIG. 1. Perforated wall 42 is also identical to the wall 42 illustrated in connection with FIG. 1.

In the embodiment illustrated in FIG. 4, a shelf 57 is provided at any of a plurality of selectable locations in the refrigerator section as shown, the shelf being of the same basic construction as shelf 56 illustrated in connection with the embodiment of FIG. 1 and additionally having aperture 59, thermostatic temperature control 65 and damper 62 as shown. When the normal refrigerator temperature control 35 and damper 37 shown in FIG. 1 are removed, or when the temperature is adjusted to maintain damper 37 in the open position, refrigerated air will flow freely through aperture 34 in central vertical wall 32 and the upper portion of refrigerator section 30 above shelf 57 will now operate as a freezer section. When the temperature sensed in the lower portion of section 30 below shelf 57 calls for refrigeration, control 65 opens damper 62 and permits entry of refrigerated air into the lower portion of section 28 until the temperature of the lower portion is equal to that of the thermostatic setting of control 65 whereby control 65 will close damper 62, preventing further entry or refrigerated air into the lower portion of section 28. Return of spent refrigerated air above shelf 57 may be provided by an aperture 71 communicating section 30 with freezer section 28. Such apertures may be suitably provided in a plurality of selectable locations with closures such as removable plugs to inactivate the apertures when not in use, as previously described. Thus, it will be seen that the shelf 57, as shown in FIG. 4, may be shifted by the consumer to any of a plurality of locations whereby the refrigerator section 30 is converted into two sections, the upper section being a freezer section and the lower section being a refrigerator section. In effect, the upper section will become an extension of the freezer section 28 shown in FIG. 4.

Figure 5:
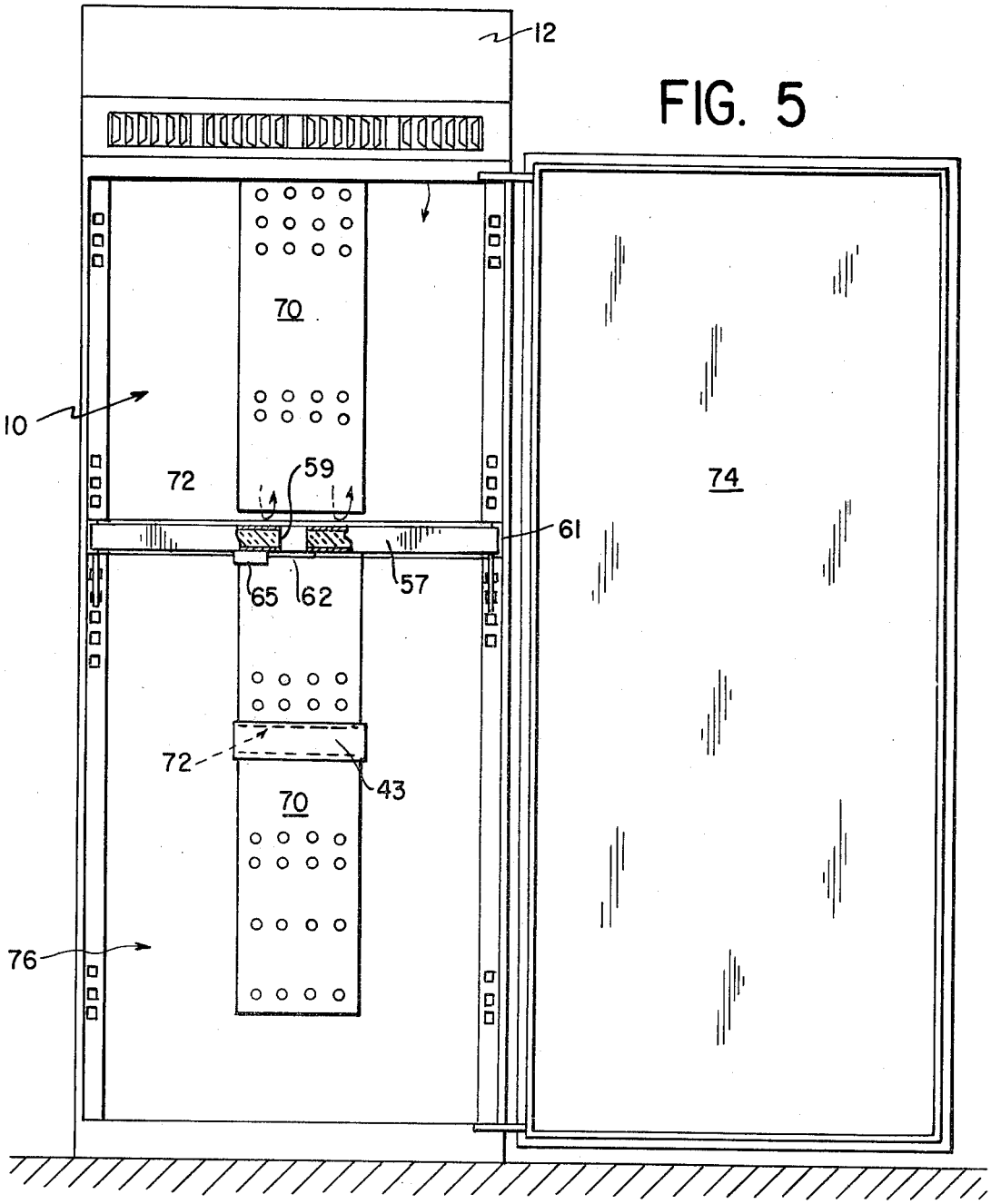
FIG. 5 is a front elevational view partially in cross-section of an alternate embodiment of the refrigerator illustrated in FIG. 1.

Referring now to FIG. 5, another embodiment of the invention is illustrated in which the refrigerating apparatus includes a single food storage compartment 10 and a refrigerating section 12. The food storage compartment 10 has a perforated wall 70 of a suitable configuration mounted forward of the rear wall to guide refrigerated air in the same manner as in the embodiment of FIG. 1. The refrigerating cycles and operation thereof are identical to the operation of the apparatus described in connection with FIG. 1. The provision of an insulating shelf 57 similar to the insulating shelf previously described in connection with FIG. 4, having control 65 and damper 62, will maintain the upper portion of the food storage compartment 10 as a freezer section and the lower portion below the shelf 56 as a standard refrigerator section in the same manner as described in connection with the previous embodiments. In the embodiment of FIG. 5 it is necessary for the manufacturer to provide a plurality of horizontal slots 72 (or other means to permit the shelf to be positioned in a manner to alter the flow of refrigerated air as described previously) in perforated wall 70 with removable cover plates 43 as shown to permit the insertion of the shelf 56 such that the sealing member 64 engages the side and the rear wall portions of the food storage compartment. Additionally, means other than slots and cover plates may be utilized, provided, the shelf is permitted to effectively alter the flow of refrigerated air as described previously. In addition, opening 59 must be positioned within the confines of the duct formed by the perforated wall so as to be positioned in the flow of refrigerated air for most effective and efficient operation. The return of spent refrigerator air from lower refrigerator section 76 is facilitated by a space provided between shelf 57 and door 74 when the door is closed. Alternately a sealing member may be provided on the forward portion of the shelf 57 for engagement with the door; however, with this arrangement a spent air return conduit will be needed to accommodate the return of spent refrigerated air from the lower section 76.

Figure 6A:
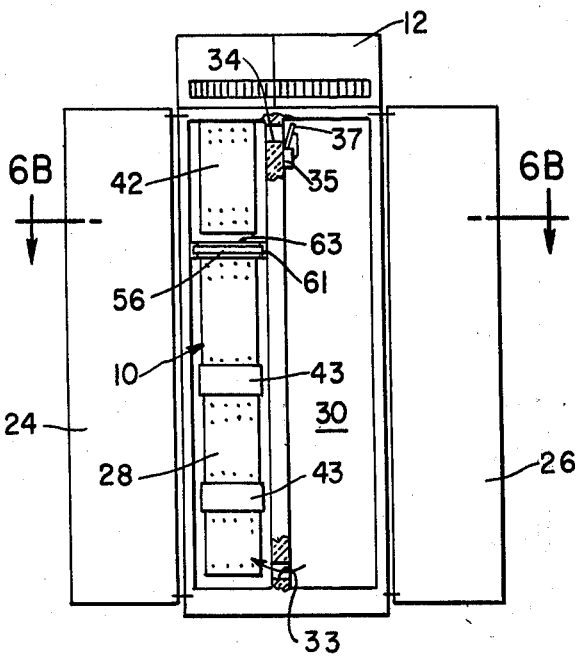
FIG. 6 is a view illustrating schematically with additional details, the arrangement of FIG. 1.
Figure 6B:
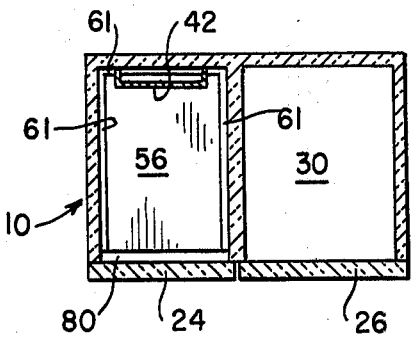

Referring now to FIG. 6A there is illustrated a shelf 56 of the type described in connection with FIG. 1 in which an upright refrigerator has a food storage compartment 10 divided into a freezer section 28 to the left of the center wall and a standard refrigerator section to the right of the center wall and perforated wall 42 has slots 63 and associated cover plates 43. FIG. 6B is a view taken along lines 6B—6B of FIG. 6A and illustrates sealing member 61 along three sides thereof and a space 80 is provided between the forward portion of shelf 56 and freezer door 24.

Figure 7A:
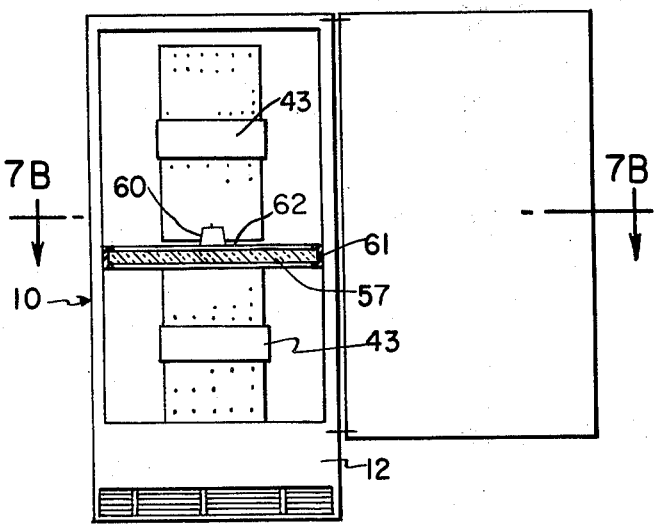
FIGS. 7–8 illustrate alternate arrangements of the invention.
Figure 7B:
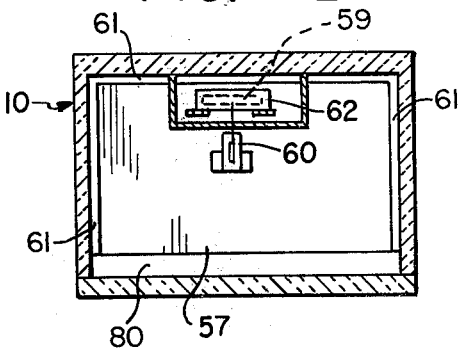

Referring now to FIGS. 7A and 7B there is illustrated still another possible variation of the invention disclosed herein wherein a refrigerating apparatus has a food storage compartment 10 and a refrigerating compartment 12 positioned below the food storage compartment 10 by the provision of an insulating shelf 57 of the type described in the embodiment of the invention of FIG. 5 having aperture 59, temperature control 65 and damper 62. The food storage compartment 10 may be converted as shown to provide a freezer compartment in the lower portion of the food storage compartment 10 and a standard refrigerator compartment in the upper portion of the food storage compartment 10. Thus, it will be observed that the position of the refrigerating compartment 12 is variable in accordance with choice of design and styling and the use of an insulating shelf 57 having temperature control 65 and damper 62 to control aperture 59 quickly converts a single food storage compartment such that the portion immediately adjacent the refrigerating compartment remains a freezer section and the portion on the opposite side of the shelf 57 becomes a standard refrigerating section. The insulating shelf 57 includes a sealing member 61 positioned along the three sides as shown for engagement with the two side walls and the rear wall of storage compartment 10. A space 80 between the front side of the shelf 57 and the forward wall (i.e., the door) of the storage compartment 10 permits the return of spent refrigerated air from the upper fresh food compartment of the lower freezer compartment so as to be returned to the refrigerating compartment 12.

Figure 8A:
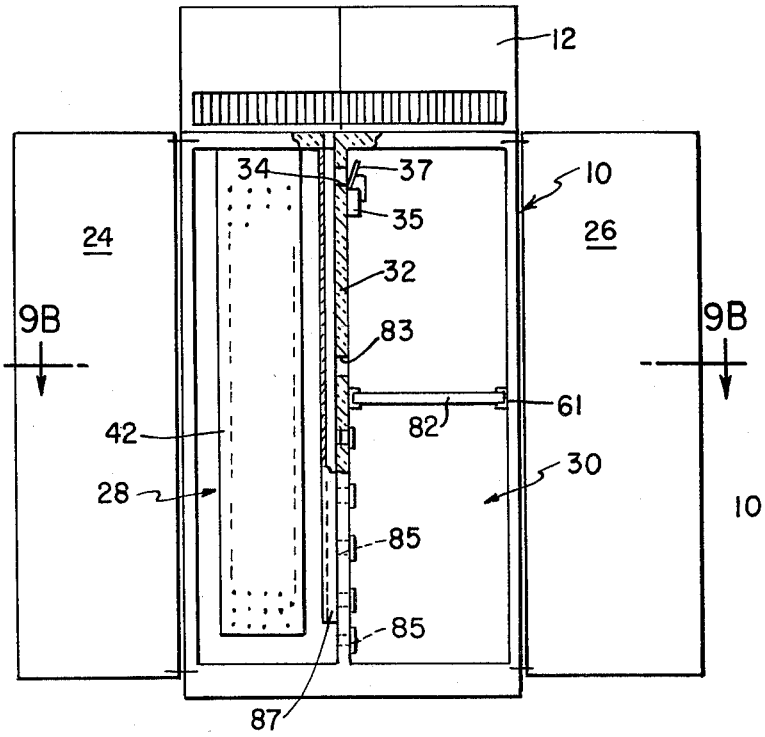
Figure 8B:
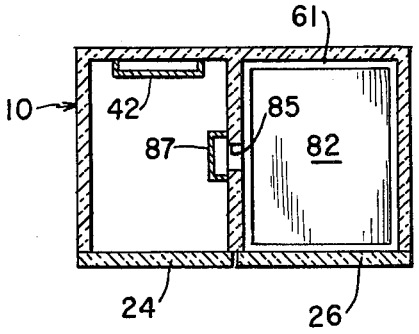

Referring now to FIG. 8, there is illustrated a refrigerating apparatus having an upright food storage compartment 10 of the same type as illustrated in FIG. 1 having side-by-side freezer and refrigerator compartments, the freezer compartment being to the left of the refrigerator compartment. Refrigerating compartment 12 is positioned above the food storage compartment 10 and a normal contemplated operation is identical to the basic refrigerating apparatus described in connection with the embodiment of FIG. 1. By the provision of an insulating shelf 82 in the refrigerator section as shown having sealing means on all sides so as to prevent all flow of air past the shelf, the portion of the refrigerator section immediately below shelf 82 is inactivated for the convenience of the consumer who does not require the use of the refrigerated space. Since this arrangement essentially inactivates return aperture 33, the return of spent refrigerated air from the standard refrigerated section above shelf 82 is facilitated by duct 87 which communicates with a series of apertures 83 and removable plugs 85 provided in vertical wall 32 as well as with the refrigerated air return opening 36 and refrigerating compartment 12 as illustrated in FIG. 2. The apertures 83 and plugs 85 are provided at a plurality of locations corresponding approximately to the anticipated positions of shelf 82 as shown in FIGS. 8A and 8B. Alternately, the flow of return air may be facilitated directly into the freezer compartment via apertures 83 in vertical wall 32. It is only necessary to provide a suitable return of spent refrigerated air from the standard refrigerator portion above shelf 82 to return the spent air to refrigerating compartment 12 and this may be provided in a known manner by the use of a series of apertures 83 and removable plugs 85 corresponding to the approximate anticipated locations of shelf 82. In similar manner, the shelf illustrated in FIG. 8 may be positioned within the freezer section to inactivate the lower portion of the freezer section below the shelf.

I claim:

1. A refrigerating apparatus which comprises at least a first compartment divided into at least one above-freezing fresh food section and at least one below-freezing freezer section adjacent the fresh food section, a wall separating the first compartment from the second compartment and having at least first and second openings defining first and second passageways interconnecting the first and second compartments, a refrigeration system mounted within said second compartment for circulating thermostatically controlled refrigerated air through the passageways between the first and second compartments to cool at least a portion of said first compartment, thermostatic control and valve means to selectively permit the flow of refrigerated air to said fresh food section and adapted to maintain the temperature of the fresh food section within a pre-selected, above-freezing temperature range, means to permit the return of refrigerated air from said fresh food section to said second compartment, at least one removable divider shelf formed at least in part of at least one insulating material and dimensioned and configured to be positioned at any of a plurality of selectable locations within at least one of said freezer and fresh food sections, said shelf having sealing means positioned along peripheral portions thereof to engage corresponding wall portions of at least one of said freezer and fresh food sections in sealed relation sufficient to prevent the flow of air past the sealed portions when positioned in one of said selectable locations, said sealing means extending at least over a sufficient portion of the periphery of said shelf such that when said shelf is positioned in at least one of said freezer and fresh food sections said shelf divides the respective section into at least two sub-sections and alters the flow of refrigerated air such that the temperature of at least one of said sub-sections on one side of said shelf is controlled within the temperature control range of the other section.

2. The refrigerating apparatus according to claim 1 wherein said second compartment includes thermostatically controlled means for directing refrigerated air to said first compartment.

3. The refrigerating apparatus according to claim 2 wherein said sealing means is constructed of a resilient material and said first and second compartments are of modular construction and separable from one another.

4. The refrigerating apparatus according to claim 2 wherein said thermostatically controlled means for circulating refrigerated air comprises a refrigeration system having:

(i) a compressor and condenser coil;

(ii) a freezer coil;

(iii) a defroster coil adjacent the freezer coil supplying heat to melt frost from the freezer coil during the defrosting cycle;

(iv) a blower adjacent the freezer coil circulating frigid air through the passageways between the first and second compartments to cool the first compartment during the refrigeration cycle;

(v) means for collecting and exhausting the melted frost from the second compartment into the ambient environment; and (vi) thermostatic control means to control the refrigeration cycle in response to measurements of the ambient temperature in said first compartment.

5. The refrigerating apparatus according to claims 2 or 3 further comprising a vertical central wall which divides the first compartment into a freezer section and a refrigerator section, said wall having one opening therein to permit refrigerated air from said freezer section to enter said refrigerator section in response to thermostatic control requirements in said refrigerator section, and a second opening therein to permit the return of said refrigerated air from said refrigerator section to said freezer section.

6. The refrigerating apparatus according to claim 5 wherein the front walls of the freezer section have a heated mullion strip mounted on its forward marginal edge portion to prevent the accumulation of frost on the forward marginal edge portion.

7. The refrigerating apparatus according to claim 6 wherein said shelf is constructed at least in part of polyurethane foam material.

8. The refrigerating apparatus according to claim 5 wherein said freezer and refrigerator sections each have a generally rectangular cross-sectional configuration and said shelf has a generally rectangular configuration corresponding to the configuration of at least one of the freezer and refrigerator sections.

9. The refrigerating apparatus according to claim 8 wherein said shelf has a sealing member positioned along at least three sides for engagement in sealed relation with the side walls and the rear wall of at least one of the freezer and refrigerator sections.

10. The refrigerating apparatus according to claim 9 wherein said shelf is dimensioned to provide a space between the forward side thereof and the associated door when the shelf is positioned in at least one of the refrigerator and freezer sections and the associated door is in a closed position, said space being sufficient to permit the return flow of spent refrigerated air thereby.

11. The refrigerating apparatus according to claim 10 wherein said sealing member is constructed of at least one of synthetic rubber, natural rubber and plastic material.

12. The refrigerating apparatus according to claim 11 wherein said shelf is constructed of polyurethane foam material having metal or plastic laminations on opposed surfaces and said sealing member is constructed of an elastomer material adhesively secured to the first section and dimensioned to engage corresponding wall portions of the food storage compartment in airtight sealed relation.

13. The refrigerating apparatus according to claim 8 wherein said shelf defines an aperture and temperature sensing and control means on one side to vary the size of the aperture in response to ambient temperatures sensed by said control means on at least one side of said shelf when said shelf is positioned in at least one of said freezer and refrigerator sections.

14. The refrigerating apparatus according to claim 13 wherein said shelf has a sealing member positioned along each side for engagement in sealed relation with the side walls, the rear wall and the door of at least one of the freezer and refrigerator sections and means are provided to facilitate the return of spent refrigerated air to said refrigerating compartment.

15. A refrigerator which comprises:

(a) a first compartment for the storage of perishable foodstuffs;

(b) a vertical insulated wall dividing said first compartment into separator below-freezing freezer and above-freezing fresh food sections, said vertical wall defining a first aperture for passage of refrigerated air from said freezer section to said fresh food section and a second aperture for the return of refrigerated air from said fresh food section to said freezer section;

(c) a second compartment adjacent to said first compartment;

(d) an insulated wall separating said first compartment from said second compartment and having at least first and second openings therein which openings define first and second passageways interconnecting the second compartment and the freezer section for circulating thermostatically controlled refrigerated air from said second compartment to said freezer section to maintain the temperature of said freezer section within a pre-selected, below-freezing temperature range, and returning said refrigerated air to said second compartment for further cooling;

(e) a refrigerated air supply duct extending along a wall portion of said freezer section and positioned to circulate thermostatically controlled refrigerated air directed through one of said passageways from said second compartment to said freezer section, said supply duct being configured to permit the return of said refrigerated air through the other of said passageways to said second compartment for further cooling;

(f) a refrigeration system mounted within said second compartment comprising:

(i) a compressor and condensor coil;

(ii) a freezer coil;

(iii) a blower adjacent the freezer coil for circulating refrigerated air through the passageways between the second compartment and the freezer section to cool the freezer section during the refrigeration cycle; and (iv) means for collecting and exhausting melted frost from the second compartment into the ambient temperature environment;

(g) thermostatic control and valve means to thermostatically control the flow of refrigerated air from said freezer section to said fresh food section through said aperture in said vertical insulated wall so as to maintain the temperature of said fresh food section within a pre-selected, above-freezing temperature range, (h) a removable divider shelf formed at least in part of at least one insulating material and dimensioned and configured to be positioned at any of a plurality of selectable locations within said freezer section, said shelf having sealing means positioned along peripheral portions thereof to engage corresponding inner wall portions of said freezer section in sealed relation sufficient to prevent the flow of air past the sealed portions when said shelf is positioned in said freezer section in one of said selectable locations, said sealing means extending at least along a sufficient portion of the periphery of said shelf such that when said shelf is positioned in said freezer section in one of said selectable locations said shelf divides said freezer section into at least two sub-sections and alters the flow of refrigerated air therethrough while permitting the return of spent refrigerated air to said second compartment for further cooling such that one sub-section of said freezer section formed by said shelf is maintained at a temperature within a pre-selected, below-freezing temperature range and the other sub-section of said freezer section is maintained at a temperature within the pre-selected, above-freezing temperature range under the thermostatic control of said fresh food section.

16. A refrigerating apparatus which comprises a first compartment divided into at least one above-freezing fresh food section and at least one below-freezing freezer section adjacent the fresh food section, a second compartment positioned adjacent the first compartment, an insulated wall separating the first compartment from the second compartment and having first and second openings defining at least first and second passageways interconnecting the second compartment and the freezer section, a refrigeration system mounted within said second compartment for circulating thermostatically controlled refrigerated air through the passageways between the second compartment and the freezer section to cool said freezer section, a refrigerated air supply duct extending along a wall portion of said freezer section and positioned to circulate the thermostatically controlled refrigerated air directed through one of said passageways from said second compartment to said freezer section within a pre-selected, below freezing temperature range, said supply duct being configured to permit the return of said refrigerated air through the other of said passageways to said second compartment for further cooling, thermostatic control and valve means to sense the ambient temperature within said fresh food section and adapted to selectively direct the flow of refrigerated air to said fresh food section to maintain the temperature of said fresh food section within a pre-selected, above-freezing temperature range, means to permit the return of said refrigerated air from said fresh food section to said second compartment, at least one divider shelf formed at least in part of at least one insulating material and dimensioned and configured to be positioned at any of a plurality of selectable locations within at least one of said freezer and fresh food sections, said shelf having sealing means positioned along peripheral portions thereof to engage corresponding wall portions of at least one of said freezer and fresh food sections in sealed relation sufficient to prevent the flow of air past the sealed portions when positioned in one of said selectable locations, said sealing means extending at least over a sufficient portion of the periphery of said shelf such that when said shelf is positioned in at least one of said freezer and fresh food sections said shelf divides the respective section into at least two sub-sections and alters the flow of refrigerated air such that the temperature of at least one of said sub-sections on one side of said shelf is controlled by the temperature control of the other section.

17. A refrigerating apparatus which comprises a first compartment divided by a vertical wall into at least one above-freezing fresh food section and at least one below-freezing freezer section adjacent the fresh food section, a freezer section door and a fresh food section door for selectively permitting access to the respective sections, a second compartment positioned adjacent the first compartment, an insulated wall separating the first compartment from the second compartment and having at least first and second openings defining first and second passageways interconnecting the second compartment and the freezer section for circulating refrigerated air through the passageways between the second compartment and the freezer section, a refrigerated air supply duct extending along a wall portion of said freezer section and positioned to circulate refrigerated air directed through one of said passageways from said second compartment to said freezer section to thermostatically cool said freezer section to maintain the temperature therein within a pre-selected, below-freezing temperature range, said supply duct being configured to permit the return of said refrigerated air through the other of said passageways from said freezer section to said second compartment for further cooling and having a plurality of substantially horizontal slots at selected locations therealong, thermostatic control and valve means to sense the ambient temperature within said fresh food section and adapted to selectively direct the flow of refrigerated air from said freezer section to said fresh food section to maintain the temperature of said fresh food section within a pre-selected, above-freezing temperature range, means to permit the return of refrigerated air from said fresh food section to said freezer section, at least one removable divider shelf formed at least in part of at least one insulating material and dimensioned and configured to be positioned at any of a plurality of selectable locations within said freezer section, said shelf having sealing means positioned along peripheral portions thereof to engage corresponding inner wall portions of said freezer section in sealed relation sufficient to prevent the flow of air past the sealed portions when positioned so as to enter one of said substantially horizontal slots in said refrigerated air supply duct, said shelf further being configured to define a space between the forward end portion thereof and said freezer door to permit the return of refrigerated air from said fresh food section through said freezer section to said second compartment for further cooling such that when said shelf is positioned in one of said selectable locations of said freezer section, the temperature of the sub-section of said freezer section closest to said second compartment is controlled by the thermostatic control and valve means of the adjacent fresh food section while maintaining the other sub-section of said freezer section within a below-freezing temperature range.

18. A refrigerating apparatus according to claim 17 wherein the second compartment is positioned above the first compartment.

19. A refrigerating apparatus according to claim 17 wherein the second compartment is positioned below the first compartment.

20. A refrigerating apparatus which comprises a first compartment divided by a vertical insulated wall into one above-freezing fresh food section and at least one below-freezing freezer section adjacent the fresh food section, a freezer section door and a fresh food section door for selectively permitting access to the respective sections, a second compartment positioned above the first compartment, an insulated wall separating said first compartment from said second compartment and having at least first and second openings defining first and second passageways interconnecting the second compartment and the freezer section for circulating thermostatically controlled refrigerated air through the passageways between the first compartment and the freezer section, a refrigerated air supply duct extending along a wall portion of said freezer section and positioned to circulate refrigerated air directed through one of said passageways from said second compartment to said freezer section to thermostatically cool said freezer section to maintain the temperature therein within a pre-selected, below-freezing temperature range, said supply duct being configured to permit the return of said refrigerated air through the other of said passageways from said freezer section to said second compartment for further cooling, an aperture defined by said vertical insulated wall for permitting refrigerated air to enter said fresh food section at a location adjacent said second compartment and a plurality of apertures defined by said vertical insulated wall to permit the return of refrigerated air from said fresh food section to said freezer section, said last mentioned apertures being capable of being selectively deactivated by insertable plug members, at least one removable divider shelf formed at least in part of at least one insulating material and dimensioned and configured to be positioned at any of a plurality of selectable locations within said fresh food section, said shelf having sealing means positioned along peripheral portions thereof to engage corresponding inner wall portions of said fresh food section in sealed relation sufficient to prevent the flow of air past the sealed portions when positioned in one of a plurality of selectable locations, each location being adjacent at least one of said apertures for directing the return of refrigerated air from said fresh food section to said freezer section, said shelf having thermostatic control and valve means to sense the ambient temperature within said fresh food section and adapted to selectively control the flow of refrigerated air from said freezer section to the portion of said fresh food section below said shelf to maintain the temperature of said fresh food section within a pre-selected, above-freezing temperature range while the portion of said fresh food section above said shelf is maintained within a pre-selected, below-freezing temperature range in accordance with the thermostatically controlled temperature range of said adjacent freezer section, said vertical insulated wall further defining at least one aperture adjacent the lower portion thereof to permit the return of refrigerated air from said fresh food section defined below said shelf to said freezer section so as to be directed through said freezer section to said second compartment for further cooling, said shelf thereby permitting selectable division of said fresh food section into below freezing freezer, and above-freezing, fresh food, sub-sections, the relative sizes of each sub-section being dependent upon the relative position of said shelf within said fresh food section.

* * * * *

UNITED STATES PATENT AND TRADEMARK OFFICE

CERTIFICATE OF CORRECTION

PATENT NO. : 4,304,101

DATED : December 8, 1981

INVENTOR(S) : Edward Gidseg

It is certified that error appears in the above-identified patent and that said Letters Patent are hereby corrected as shown below:

Column 12, line 52, (Claim 15, line 5),

"separator" should read -- separate --

Signed and Sealed this

*Twenty-ninth* Day of *June 1982*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,304,101

DATED : December 8, 1981

INVENTOR(S) : Edward Gidseg

It is certified that error appears in the above-identified patent and that said Letters Patent is hereby corrected as shown below:

Column 6, line 43, change "below" to --above--.

Signed and Sealed this

*Thirty-first* Day of *December 1985*

[SEAL]

*Attest:*

DONALD J. QUIGG

*Attesting Officer*

*Commissioner of Patents and Trademarks*